US012781393B2

(12) United States Patent
Yoshikawa et al.

(10) Patent No.: US 12,781,393 B2
(45) Date of Patent: Nov. 3, 2026

(54) ACRYLIC FIBER FOR ARTIFICIAL HAIR, HAIR ORNAMENT PRODUCT INCLUDING THE SAME, AND PRODUCTION METHOD THEREFOR

(71) Applicant: KANEKA CORPORATION, Osaka (JP)

(72) Inventors: Megumi Yoshikawa, Takasago (JP); Atsushi Honda, Takasago (JP); Ayano Tanaka, Takasago (JP); Takeshi Tanaka, Takasago (JP)

(73) Assignee: KANEKA CORPORATION, Osaka (JP)

( * ) Notice: Subject to any disclaimer, the term of this patent is extended or adjusted under 35 U.S.C. 154(b) by 268 days.

(21) Appl. No.: 18/694,347

(22) PCT Filed: Aug. 25, 2022

(86) PCT No.: PCT/JP2022/032106

§ 371 (c)(1),
(2) Date: Mar. 21, 2024

(87) PCT Pub. No.: WO2023/047882

PCT Pub. Date: Mar. 30, 2023

(65) Prior Publication Data

US 2024/0401243 A1 Dec. 5, 2024

(30) Foreign Application Priority Data

Sep. 24, 2021 (JP) ..... 2021-155901
Mar. 28, 2022 (JP) ..... 2022-052438

(51) Int. Cl.
*D01F 6/40* (2006.01)
*A41G 3/00* (2006.01)
(Continued)

(52) U.S. Cl.
CPC ..... *D01F 6/40* (2013.01); *A41G 3/0083* (2013.01); *D01D 5/06* (2013.01); *D01D 5/253* (2013.01);
(Continued)

(58) Field of Classification Search
None
See application file for complete search history.

(56) References Cited

U.S. PATENT DOCUMENTS 4,524,193 A * 6/1985 Yamazaki ..... D01F 6/40 526/287
4,559,268 A 12/1985 Nakashima et al.
(Continued)

FOREIGN PATENT DOCUMENTS

EP 0130611 A2 1/1985
JP S48001220 A 1/1973
(Continued)

OTHER PUBLICATIONS

Machine translation of JPWO2006135060 (Year: 2009).*
Machine translation of WO2020039704 (Year: 2020).*

*Primary Examiner* — Shawn Mckinnon
(74) *Attorney, Agent, or Firm* — Alleman Hall LLP

(57) ABSTRACT

The present invention relates to an acrylic fiber for artificial hair containing an acrylic copolymer. The fiber cross-section of the acrylic fiber has one or more shapes selected from the group consisting of a C-shape, a figure-6-shape, and a broad bean-shape with a hollow portion. Two ends of the C-shape, the figure-6-shape, or the broad bean-shape are apart from each other or are in contact with each other. A circumcircle of the fiber cross section has a diameter of 70 μm or more and 100 μm or less, an inscribed circle of the fiber cross section has a diameter of 15 μm or more and 50 μm or less, the thickness of the fiber cross section is 13 μm or more and
(Continued)

40 μm or less, and the canal width between the ends of the fiber cross section is 0 μm or more and 15 μm or less.

16 Claims, 8 Drawing Sheets

(51) Int. Cl.

| | |
|---|---|
| ***D01D 5/06*** | (2006.01) |
| ***D01D 5/253*** | (2006.01) |
| ***D01F 6/32*** | (2006.01) |
| ***D06M 13/224*** | (2006.01) |
| ***D06M 15/53*** | (2006.01) |
| ***D06M 101/28*** | (2006.01) |

(52) U.S. Cl.
CPC ..... *D01F 6/32* (2013.01); *D06M 13/224* (2013.01); *D06M 15/53* (2013.01); *D06M 2101/28* (2013.01); *D10B 2321/10* (2013.01); *D10B 2321/101* (2013.01); *D10B 2503/08* (2013.01)

(56) References Cited

U.S. PATENT DOCUMENTS

2006/0237869 A1* 10/2006 Moon ..... A41G 3/0083 264/172.11
2008/0210250 A1 9/2008 Horihata et al.

FOREIGN PATENT DOCUMENTS

JP S6017109 A 1/1985
JP WO2006135060 * 1/2009
WO 2006135060 A1 12/2006
WO WO2020039704 * 2/2020

* cited by examiner

ACRYLIC FIBER FOR ARTIFICIAL HAIR, HAIR ORNAMENT PRODUCT INCLUDING THE SAME, AND PRODUCTION METHOD THEREFOR

TECHNICAL FIELD

The present invention relates to an acrylic fiber for artificial hair to be used in a hair ornament product such as a hairpiece, a hair ornament product including the same, and a production method therefor.

BACKGROUND ART

Conventionally, softness and bulkiness are imparted to a fiber to be used for artificial hair. For example, Patent Document 1 discloses, as a fiber for artificial hair having both softness and bulkiness, a vinyl chloride-based fiber with a C-shaped fiber cross-section in which the maximum external size passing the center of an imaginary circle inscribed in a hollow portion, the diameter of the imaginary circle inscribed in the hollow portion, and an angle formed by line segments connecting the imaginary circle inscribed in the hollow portion and the two ends of the C-shape are set to be within predetermined ranges.

PRIOR ART DOCUMENTS

Patent Documents

Patent Document 1: WO 2006/135060

DISCLOSURE OF INVENTION

Problem to be Solved by the Invention

On the other hand, a fiber for artificial hair is required to have curl setting properties, particularly hot-water curl setting properties.

The present invention provides an acrylic fiber for artificial hair having favorable bulkiness, favorable touch, and favorable curl setting properties, a hair ornament product including the same, and a production method therefor.

Means for Solving Problem

One or more embodiments of the present invention relate to an acrylic fiber for artificial hair containing an acrylic copolymer, wherein a fiber cross-section of the acrylic fiber for artificial hair has one or more shapes selected from the group consisting of a C-shape, a figure-6-shape, and a broad bean-shape with a hollow portion, two ends of the C-shape, the figure-6-shape, or the broad bean-shape with the hollow portion are apart from each other or are in contact with each other, and a circumcircle of the fiber cross section has a diameter of 70 μm or more and 100 μm or less, an inscribed circle of the fiber cross section has a diameter of 15 μm or more and 50 μm or less, a thickness of the fiber cross section is 13 μm or more and 40 μm or less, and a canal width between the ends of the fiber cross section is 0 μm or more and 15 μm or less.

One or more embodiments of the present invention relate to a hair ornament product including the above-mentioned acrylic fiber for artificial hair.

One or more embodiments of the present invention relate to a method for producing the above-mentioned acrylic fiber for artificial hair, the method including a step of performing wet spinning using a spinning solution containing an acrylic copolymer, wherein a nozzle used for the wet spinning has a C-shaped cross-section with two ends being apart from each other, each of the two ends of the C-shape has a linear portion and a protrusion bulging outward, and the linear portions of the two ends are parallel to each other or one end of the C-shape is located on a side close to a hollow portion with respect to the other end.

Effects of the Invention

With the present invention, it is possible to provide an acrylic fiber for artificial hair having favorable bulkiness, favorable touch, and favorable curl setting properties, and a hair ornament product including the same.

Also, with the production method of the present invention, it is possible to obtain an acrylic fiber for artificial hair having favorable bulkiness, favorable touch, and favorable curl setting properties through wet spinning.

DESCRIPTION OF THE INVENTION

Figure 6:
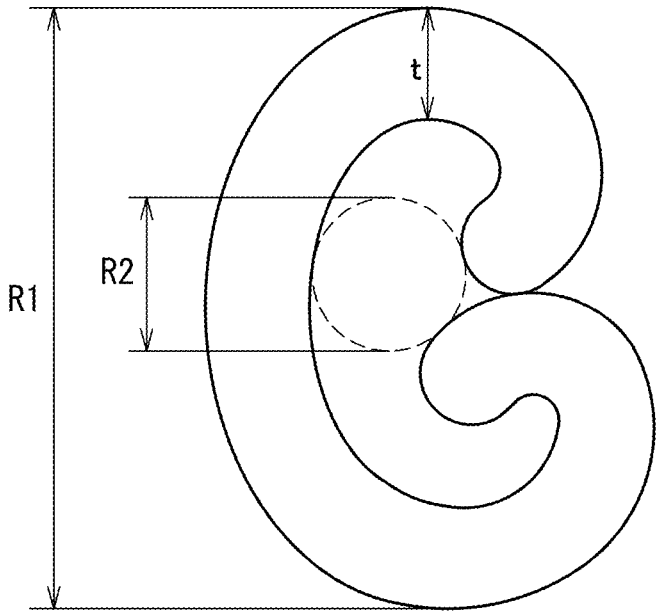
FIG. 6 is a schematic cross-sectional view (broad bean-shape with a hollow portion) of an acrylic fiber according to one or more embodiments of the present invention.

The inventors of the present invention found that, in an acrylic fiber for artificial hair with a fiber cross-section having one or more shapes selected from the group consisting of a C-shape, a figure-6-shape, and a broad bean-shape with a hollow portion, favorable bulkiness, favorable touch, and favorable curl setting properties (particularly hot-water curl setting properties) were achieved by setting the diameter of a circumcircle of the fiber cross-section, the diameter of an inscribed circle, the thickness, and the width of a canal between the ends to 70 μm or more and 100 μm or less, 15 μm or more and 50 μm or less, 13 μm or more and 40 μm or less, and 0 μm or more and 15 μm or less, respectively.

In one or more embodiments of the present invention, the fiber cross-section of the acrylic fiber for artificial hair has one or more shapes selected from the group consisting of a C-shape, a figure-6-shape, and a broad bean-shape with a hollow portion (also referred to simply as a "hollow broad bean-shape" hereinafter).

Figure 1:
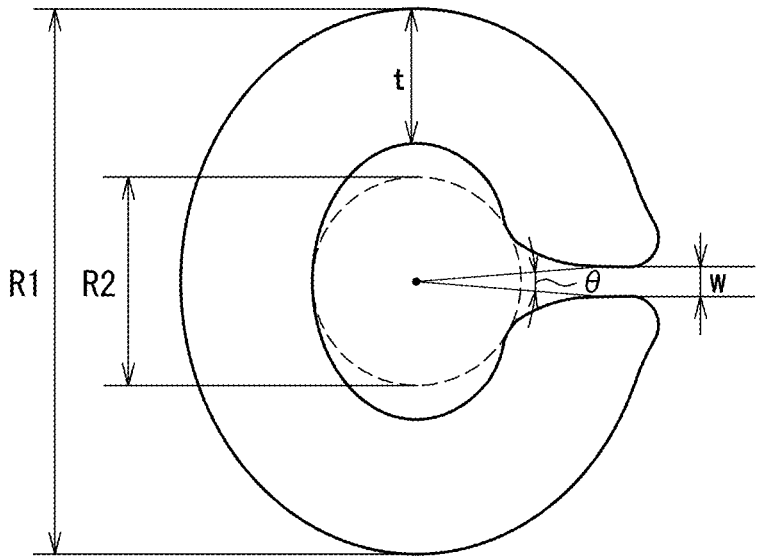
FIG. 1 is a schematic cross-sectional view (C-shape) of an acrylic fiber according to one or more embodiments of the present invention.
Figure 2:
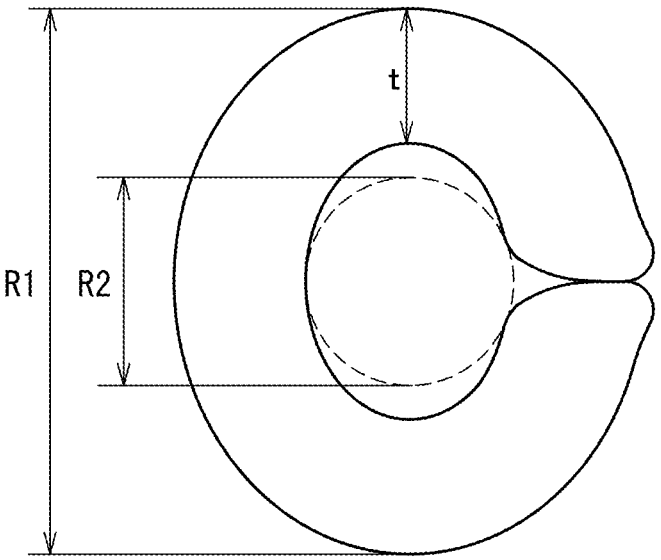
FIG. 2 is a schematic cross-sectional view (C-shape) of an acrylic fiber according to one or more embodiments of the present invention.

FIGS. 1 and 2 are schematic cross-sectional views each showing an acrylic fiber for artificial hair with a C-shaped cross-section according to an example. In the C-shaped fiber cross-section shown in FIG. 1, the two ends of the C-shape are apart from each other, and thus a hollow portion with an opening is formed. In the C-shaped fiber cross-section shown in FIG. 2, the two ends of the C-shape are in contact with each other, and thus a hollow portion with no opening is formed.

Figure 3:
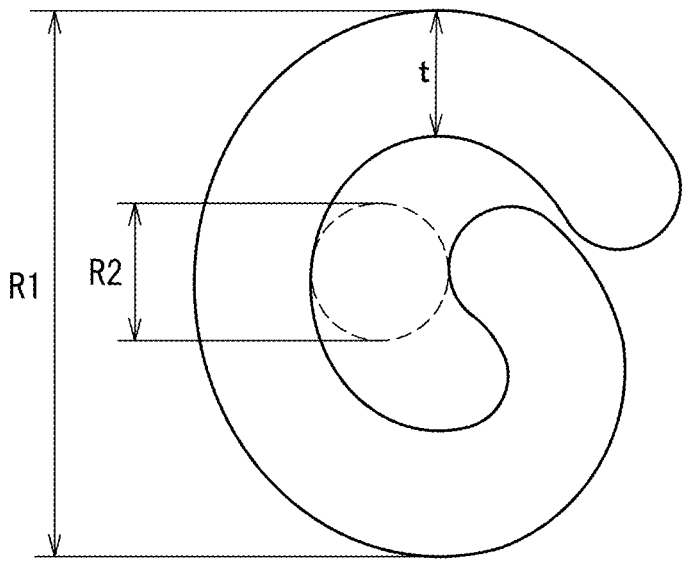
FIG. 3 is a schematic cross-sectional view (figure-6-shape) of an acrylic fiber according to one or more embodiments of the present invention.
Figure 4:
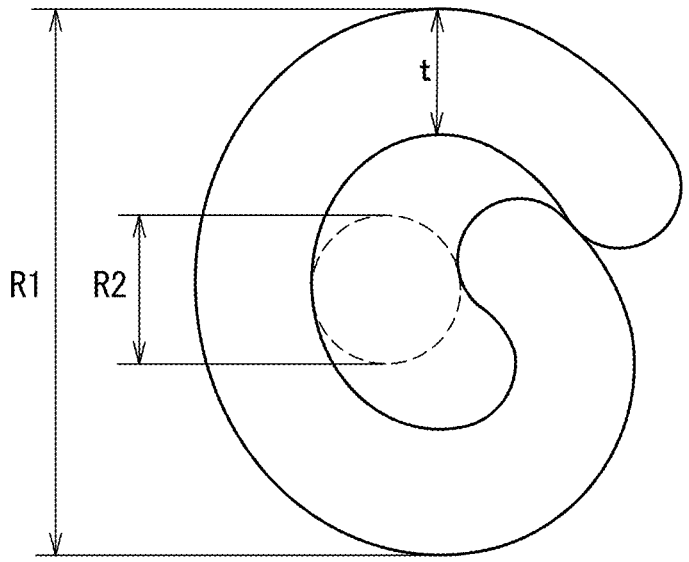
FIG. 4 is a schematic cross-sectional view (figure-6-shape) of an acrylic fiber according to one or more embodiments of the present invention.

FIGS. 3 and 4 are schematic cross-sectional views each showing an acrylic fiber for artificial hair with a figure-6-shaped cross-section according to an example. In one or more embodiments of the present invention, the figure-6-shape can also be considered as a modified C-shape, and specifically, it can also be considered as a shape in which one end of the C-shape is located on the inside (i.e., on a side close to the hollow portion) with respect to the other end. In the figure-6-shaped fiber cross-section shown in FIG. 3, the two ends of the figure-6-shape are apart from each other, and thus a hollow portion with an opening is formed. In the figure-6-shaped fiber cross-section shown in FIG. 4, the two ends of the figure-6-shape are in contact with each other, and thus a hollow portion with no opening is formed.

Figure 5:
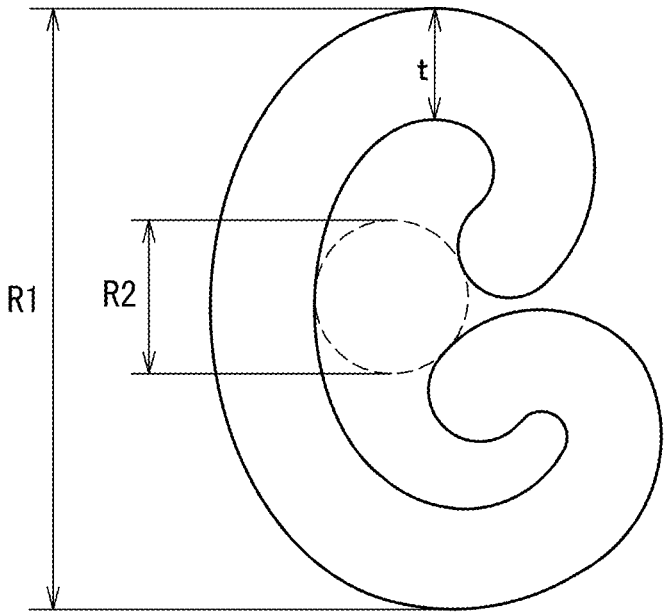
FIG. 5 is a schematic cross-sectional view (broad bean-shape with a hollow portion) of an acrylic fiber according to one or more embodiments of the present invention.

FIGS. 5 and 6 are schematic cross-sectional views each showing an acrylic fiber for artificial hair with a hollow broad bean-shaped (kidney-shaped) cross-section according to an example. In one or more embodiments of the present invention, the hollow broad bean-shape can also be considered as a modified C-shape, and specifically, it can also be considered as a shape in which the two ends of the C-shape are curved toward the hollow portion. In the hollow broad bean-shaped fiber cross-section shown in FIG. 5, the two ends are apart from each other, and thus a hollow portion with an opening is formed. In the hollow broad bean-shaped fiber cross-section shown in FIG. 6, the two ends are in contact with each other, and thus a hollow portion with no opening is formed.

In the acrylic fiber for artificial hair of one or more embodiments of the present invention, the diameter of the circumcircle is not particularly limited but is preferably 75 μm or more, more preferably 80 μm or more, and even more preferably 85 μm or more, from the viewpoint of further improving the bulkiness and the touch. In this specification, "the diameter of the circumcircle of the fiber cross-section" means the diameter of an imaginary circumcircle of the fiber cross section. For example, in FIGS. 1 to 6, the diameter of the circumcircle is indicated as R1. Note that when there are a plurality of imaginary circumcircles of the fiber cross-section, the maximum diameter among all the diameters of the circumcircles is taken as the diameter of the circumcircle of the fiber cross section.

In the acrylic fiber for artificial hair of one or more embodiments of the present invention, the diameter of the inscribed circle is not particularly limited but is preferably 18 μm or more, more preferably 20 μm or more, even more preferably 22 μm or more, and particularly preferably 25 μm or more, from the viewpoint of achieving favorable bulkiness and favorable touch and further improving the curl setting properties. In this specification, "the diameter of the inscribed circle of the fiber cross-section" means the diameter of an imaginary circle inscribed to the hollow portion of the fiber cross section. For example, in FIGS. 1 to 6, the diameter of the inscribed circle is indicated as R2. Note that when there are a plurality of imaginary circles inscribed to the hollow portion of the fiber cross-section, the maximum diameter among all the diameters of the inscribed circles is taken as the diameter of the inscribed circle of the fiber cross section.

In the acrylic fiber for artificial hair of one or more embodiments of the present invention, the thickness of the fiber cross-section is preferably 15 μm or more and 40 μm or less, more preferably 16 μm or more and 38 μm or less, even more preferably 16 μm or more and 36 μm or less, even more preferably 17 μm or more and 34 μm or less, and particularly preferably 17 μm or more and 32 μm or less, from the viewpoint of achieving favorable bulkiness and favorable touch and further improving the curl setting properties, particularly hot-water curl setting properties (also referred to as "HWS properties" hereinafter). For example, in FIGS. 1 to 6, the thickness is indicated as t. The thickness may be uniform over the entire fiber cross-section or may vary. When the thickness of the fiber cross-section varies, both a maximum thickness t1 and a minimum thickness t2 are 13 μm or more and 40 μm or less, preferably 15 μm or more and 40 μm or less, more preferably 16 μm or more and 38 μm or less, even more preferably 16 μm or more and 36 μm or less, even more preferably 17 μm or more and 34 μm or less, and particularly preferably 17 μm or more and 32 μm or less.

In the acrylic fiber for artificial hair of one or more embodiments of the present invention, the width of the canal between the two ends in the fiber cross-section (referred to simply as a "canal width" hereinafter) is preferably 10 μm or less, more preferably 8 μm or less, even more preferably 6 μm or less, and particularly preferably 4 μm or less, from the viewpoint of achieving favorable touch and favorable curl setting properties and further improving the bulkiness. In FIG. 1, the canal width is indicated as W. When the two ends in the C-shaped fiber cross-section are in contact with each other as shown in FIG. 2, the "canal width" is 0 μm. In this case, although the cross-sectional shape is similar to that of a hollow fiber that has a circular fiber cross-section and includes a circular hollow portion, a portion where the two ends of the C-shape are in contact can be confirmed through observation under a microscope. In one or more embodiments of the present invention, when the fiber cross-section has a figure-6-shape or a hollow broad bean-shape, the "canal width" is 0 μm.

In the acrylic fiber for artificial hair of one or more embodiments of the present invention, the angle between the ends in the fiber cross-section (referred to simply as an "angle between the ends" hereinafter) is not particularly limited but is preferably 0° or more and 20° or less, more preferably 0° or more and 15° or less, even more preferably 0° or more and 10° or less, even more preferably 0° or more and 8° or less, and particularly preferably 0° or more and 5° or less, from the viewpoint of further improving the bulkiness. In one or more embodiments of the present invention, the "angle between the ends" means an angle between line segments that connect the center of the imaginary inscribed circle and the two ends in the C-shaped fiber cross-section. For example, in FIG. 1, the angle between the ends is indicated as θ. When the two ends in the C-shaped fiber cross-section are in contact with each other as shown in FIG. 2, "the angle between the ends" is 0°. In this case, although the cross-sectional shape is similar to that of a hollow fiber that has a circular fiber cross-section and includes a circular hollow portion, a portion where the two ends of the C-shape are in contact can be confirmed through observation under a microscope. In one or more embodiments of the present invention, when the fiber cross-section has a figure-6-shape or a hollow broad bean-shape, the "angle between the ends" is 0°.

In the acrylic fiber for artificial hair of one or more embodiments of the present invention, the flexural rigidity is not particularly limited but is preferably $4.0\times10^{-3}$ gf·cm$^2$/yarn or more, more preferably $5.0\times10^{-3}$ gf·cm$^2$/yarn or more, and even more preferably $6.0\times10^{-3}$ gf·cm$^2$/yarn or more, from the viewpoint of further improving the bulkiness. In the acrylic fiber for artificial hair of one or more embodiments of the present invention, the upper limit of the flexural rigidity is not particularly limited but is preferably $15.0\times10^{-3}$ gf·cm$^2$/yarn or less, more preferably $14.0\times10^{-3}$ gf·cm$^2$/yarn or less, and even more preferably $13.0\times10^{-3}$ gf·cm$^2$/yarn or less, from the viewpoint of the touch. In this specification, the "flexural rigidity" can be measured as described in Examples.

In the acrylic fiber for artificial hair of one or more embodiments of the present invention, the torsional rigidity is not particularly limited but is preferably 1.3 mg-cm$^2$ or more, more preferably 1.5 mg-cm$^2$ or more, and even more preferably 1.7 mg-cm$^2$ or more, from the viewpoint of further improving the curl setting properties, particularly the HWS properties. Also, in the acrylic fiber for artificial hair of one or more embodiments of the present invention, the torsional rigidity is not particularly limited but is preferably 6.0 mg-cm$^2$ or less, more preferably 5.5 mg-cm$^2$ or less, and even more preferably 5.0 mg-cm$^2$ or less, from the viewpoint of improving strength against external force. In this specification, the "torsional rigidity" can be measured as described in the Examples.

The content of the C-shaped fiber cross-section in the cross-sections of the acrylic fibers for artificial hair of one or more embodiments of the present invention is preferably 50% or more, more preferably 60% or more, even more preferably 70% or more, even more preferably 80% or more, and particularly preferably 90% or more, from the viewpoint of achieving high torsional rigidity and further improving the curl setting properties, particularly the HWS properties. In this specification, the C-shaped fiber cross-section content can be measured as described in the Examples.

In one or more embodiments of the invention, an acrylic copolymer contained in the acrylic fiber for artificial hair is not particularly limited, and, for example, the acrylic copolymer contains acrylonitrile in an amount of less than 95 wt % and another monomer in an amount of more than 5 wt %, and preferably acrylonitrile in an amount of less than 80 wt % and another monomer in an amount of more than 20 wt %. The other monomer is not particularly limited as long as it can copolymerize with acrylonitrile. Specifically, it is more preferable that the acrylic copolymer contained in the acrylic fiber for artificial hair contains acrylonitrile in an amount of 29.5 wt % or more and 79.5 wt % or less, vinyl chloride and/or vinylidene chloride in an amount of 20 wt % or more and 70 wt % or less, and a sulfonic acid group-containing vinyl monomer in an amount of 0.5 wt % or more and 5 wt % or less. That is to say, it is more preferable that the acrylic copolymer is obtained through polymerization performed using a monomer mixture containing acrylonitrile in an amount of 29.5 wt % or more and 79.5 wt % or less, vinyl chloride and/or vinylidene chloride in an amount of 20 wt % or more and 70 wt % or less, and a sulfonic acid group-containing vinyl monomer in an amount of 0.5 wt % or more and 5 wt % or less with the total content thereof being 100 wt %. When the content of acrylonitrile in the acrylic copolymer is 29.5 wt % or more and 79.5 wt % or less, the heat resistance is favorable. When the content of vinyl chloride and/or vinylidene chloride in the acrylic copolymer is 20 wt % or more and 70 wt % or less, the flame retardance is favorable. The hydrophilicity is increased due to the acrylic copolymer containing a sulfonic acid group-containing vinyl monomer in an amount of 0.5 wt % or more and 5 wt % or less. When the total amount of the acrylic copolymer is taken as 100 wt %, the acrylic copolymer more preferably contains acrylonitrile in an amount of 34.5 wt % or more and 74.5 wt % or less, vinyl chloride and/or vinylidene chloride in an amount of 25 wt % or more and 65 wt % or less, and a sulfonic acid group-containing vinyl monomer in an amount of 0.5 wt % or more and 5 wt % or less, and particularly preferably acrylonitrile in an amount of 39.5 wt % or more and 74.5 wt % or less, vinyl chloride in an amount of 25 wt % or more and 60 wt % or less, and a sulfonic acid group-containing vinyl monomer in an amount of 0.5 wt % or more and 5 wt % or less. It is preferable that the acrylic copolymer contains vinyl chloride from the viewpoint of achieving better touch.

Although the sulfonic acid group-containing vinyl monomer is not particularly limited, examples thereof include allylsulfonic acid, methallylsulfonic acid, styrenesulfonic acid, isoprenesulfonic acid, and 2-acrylamido-2-methylpropanesulfonic acid, and metallic salts (e.g., sodium salts) thereof and amine salts thereof. One type of the sulfonic acid group-containing vinyl monomer may be used alone, or two or more types of the sulfonic acid group-containing vinyl monomers may be used in combination.

In one or more embodiments of the present invention, it is preferable that a fiber treatment agent is adhered to the acrylic fiber for artificial hair from the viewpoint of further improving the touch, and it is more preferable that the fiber treatment agent contains a fatty acid ester oil and polyoxyethylene surfactant. In general, better touch can be achieved by using the fatty acid ester oil and the polyoxyethylene surfactant, which are used to improve the texture of an acrylic fiber, together, compared with the case of using only one of the fatty acid ester oil and the polyoxyethylene surfactant.

In one or more embodiments of the present invention, the adhesion amount of the fiber treatment agent with respect to 100 parts by weight of the acrylic fiber for artificial hair is preferably 0.1 parts by weight or more and 1.0 part by weight or less, more preferably 0.2 parts by weight or more and 0.6 parts by weight or less, and more preferably 0.2 parts by weight or more and 0.4 parts by weight or less, from the viewpoint of further improving the touch. In this specification, the adhesion amount of the fiber treatment agent in the acrylic fiber for artificial hair is measured and calculated as described in Example.

In one or more embodiments of the present invention, the acrylic fiber for artificial hair may contain other additives to improve the fiber characteristics if necessary as long as the effects of the present invention are not inhibited. Examples of the additives include the following functional agents:

gloss control agents such as titanium dioxide, silicon dioxide, and esters and ethers of cellulose derivatives including cellulose acetate; coloring agents such as organic pigments, inorganic pigments, and dyes; stabilizers for improving light resistance and heat resistance; fiber sizing agents such as a urethane polymer and a cationic ester polymer for improving the processability of the fibers during braiding or twisting; inorganic or organic deodorants for capturing isovaleric acid that is an odor component generated from the scalp; and aromatic agents for giving an aroma such as a citrus aroma to the artificial hair fibers.

The acrylic fiber for artificial hair can be produced through wet spinning using a spinning solution containing the above-described acrylic copolymer. The spinning solution can be obtained by, for example, dissolving the acrylic copolymer in an organic solvent. The organic solvent is not particularly limited, and a good solvent for the acrylic copolymer can be used as appropriate. Examples of the organic solvent include dimethyl sulfoxide (DMSO), dimethylacetamide (DMAc), N,N-dimethylformamide (DMF), and acetone. Acetone may be used from the viewpoint of versatility. Dimethyl sulfoxide may be used from the viewpoint of high safety. The spinning solution may contain a small amount of water, such as water in an amount of 1.5 wt % or more and 4.8 wt % or less. This can reduce the formation of voids.

The spinning solution preferably contains an epoxy group-containing compound in an amount of 0.1 parts by weight or more, more preferably 0.2 parts by weight or more, and even more preferably 0.3 parts by weight or more, with respect to 100 parts by weight of the acrylic copolymer. It is preferable that spinning solution contains the epoxy group-containing compound because foul odor, coloring of the fibers caused by heat, devitrification of the fiber caused by hot water, and the like can be suppressed. In particular, when dimethyl sulfoxide is used as the organic solvent, the epoxy group-containing compound can effectively reduce the generation of malodorous components caused by the decomposition of the dimethyl sulfoxide while the acrylic fiber for artificial hair is being heated. Also, the spinning solution preferably contains the epoxy group-containing compound in an amount of 5 parts by weight or less, more preferably 3 parts by weight or less, and even more preferably 1 part by weight or less, with respect to 100 parts by weight of the acrylic copolymer from the viewpoint of spinnability, fiber quality, and cost.

Examples of the epoxy group-containing compound include a glycidyl methacrylate-containing polymer, a glycidyl acrylate-containing polymer, an epoxidized vegetable oil, a glycidyl ether epoxy resin, a glycidyl amine epoxy resin, a glycidyl ester epoxy resin, and a cyclic aliphatic epoxy resin. One type of the epoxy group-containing compound may be used alone, or two or more types of the epoxy group-containing compounds may be used in combination.

The epoxy group-containing compound is preferably a glycidyl methacrylate-containing polymer and/or a glycidyl acrylate-containing polymer, and more preferably polyglycidyl methacrylate, from the viewpoint of epoxy equivalent (i.e., the weight of the resin containing 1 equivalent of epoxy group), suppressing the coloring of the fibers, the solubility in dimethyl sulfoxide, and reducing the elution into a spinning bath.

The weight average molecular weight of the epoxy group-containing compound is not particularly limited, and is preferably determined as appropriate in view of, for example, the solubility in dimethyl sulfoxide and the elution into a spinning bath. When the epoxy group-containing compound is a glycidyl methacrylate-containing polymer and/or a glycidyl acrylate-containing polymer, the weight average molecular weight is, for example, preferably 3,000 or more from the viewpoint of reducing the elution into the spinning bath and preferably 100,000 or less from the viewpoint of the solubility in an organic solvent such as dimethyl sulfoxide.

The spinning solution may contain other additives to improve the fiber characteristics if necessary as long as the effects of the present invention are not inhibited. Examples of the additives include gloss control agents such as titanium dioxide, silicon dioxide, and esters and ethers of cellulose derivatives including cellulose acetate; coloring agents such as organic pigments, inorganic pigments, and dyes; and stabilizers for improving light resistance and heat resistance.

The wet spinning may include at least a coagulation process, a water-washing process, and a drying process. The wet spinning preferably includes a bath drawing process that is to be performed before or after the water-washing process and before the drying process. Moreover, the wet spinning preferably includes an oil application process that is to be performed before the drying process. Furthermore, the wet spinning may include a drawing process and a thermal relaxation process that are to be performed after the drying process.

First, in the coagulation process, the spinning solution is discharged through a spinning nozzle into a coagulation bath, where the discharged spinning solution is coagulated to form filaments (also referred to as "coagulated filaments").

The nozzle used for the wet spinning is not particularly limited, and, for example, a nozzle with a C-shaped cross-section can be used. An end of the C-shape may include a linear portion, or may have an arc shape. Also, the two ends of the C-shape may be symmetrically or asymmetrically located relative to the central axis of the hollow portion. An acrylic fiber having a desired cross-sectional shape and desired dimensions can be obtained by adjusting the spinning conditions such as the spinning rate, the nozzle draft, and the draw ratio according to the nozzle shape.

Figure 7:
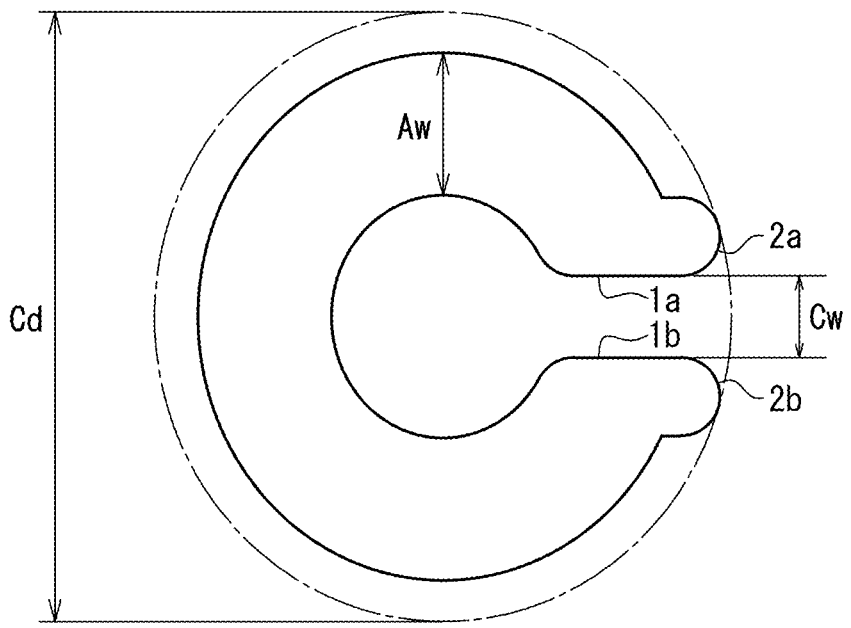
FIG. 7 is a schematic cross-sectional view of a wet-spinning nozzle according to an example.

Using, as the nozzle used for the wet spinning, a nozzle that, for example, has a cross-section with a C-shape whose two ends are apart from each other and in which each of the ends of the C-shape includes a linear portion and a protrusion bulging outward makes it possible to favorably obtain an acrylic fiber with a fiber cross-section having the above-described shape and dimensions, and particularly an acrylic fiber with a C-shape having the above-described dimensions. Also, it is more preferable that the linear portions of the two ends are parallel to each other. That is to say, using a nozzle (also referred to as a "type-I spinning nozzle" hereinafter) that has a cross-section with a C-shape whose two ends are apart from each other and in which each of the ends of the C-shape includes a linear portion and a protrusion bulging outward and the linear portions of the two ends are parallel to each other makes it possible to favorably obtain an acrylic fiber with a fiber cross-section having the above-described shape and dimensions, and particularly an acrylic fiber with a C-shape having the above-described dimensions. FIG. 7 is a schematic cross-sectional view of a type-I spinning nozzle according to an example. In the cross-section of the type-I spinning nozzle, one of the two ends of the C-shape includes a linear portion 1*a* and a protrusion 2*a*, and the other includes a linear portion 1*b* and a protrusion 2*b*, the linear portions 1*a* and 1*b* being parallel to each other. The linear portions and the protrusions can be adjusted as appropriate in accordance with the target fiber cross-sectional shape and size. In the type-I spinning nozzle, a diameter Cd of a circumcircle may be 0.37 mm or more and 0.60 mm or less, a canal width Cw may be 0.06 mm or more and 0.24 mm or less, a slit width Aw may be 0.06 mm or more and 0.15 mm or less, and the pore area may be 0.0850 $mm^2$ or more and 0.1256 $mm^2$ or less.

Figure 8:
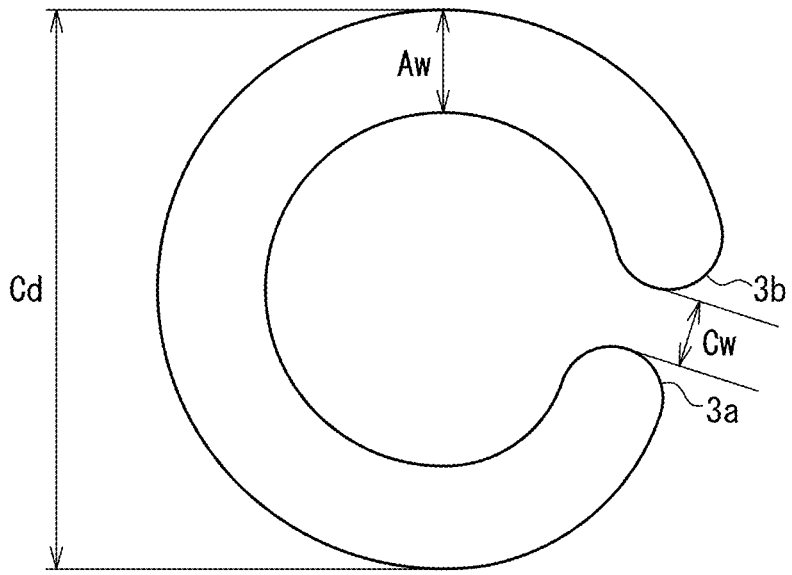
FIG. 8 is a schematic cross-sectional view of a wet-spinning nozzle according to an example.

Using, as the nozzle used for the wet spinning, a nozzle (also referred to as a "type-II spinning nozzle" hereinafter) that, for example, has a cross-section with a C-shape in which one end of the C-shape is located on the inside with respect to the other end makes it possible to favorably obtain an acrylic fiber that is resistant to external force during the production and has a fiber cross-section having the above-described shape and dimensions. FIG. 8 is a schematic cross-sectional view of a type-II spinning nozzle according to an example. In the type-II spinning nozzle, one end 3*a* of the C-shape is located on the inside (i.e., on a side close to the hollow portion) with respect to the other end 3*b*. The degree of a difference between the positions of the two ends can be adjusted as appropriate in accordance with the target fiber cross-sectional shape and size. In the cross-section of the type-II spinning nozzle, the diameter Cd of a circumcircle may be 0.37 mm or more and 0.60 mm or less, the canal width Cw may be 0.06 mm or more and 0.24 mm or less, the slit width Aw may be 0.06 mm or more and 0.15 mm or less, and the pore area may be 0.0850 $mm^2$ or more and 0.1256 $mm^2$ or less.

The spinning rate is not particularly limited, but is preferably 2 m/min or more and 17 m/min or less, for example, from the viewpoint of industrial productivity. The nozzle draft is not particularly limited, but is preferably 0.8 or more and 2.0 or less, for example, from the viewpoint of the stability of the production process. An acrylic fiber having a predetermined cross-sectional shape and a predetermined cross-sectional size can be obtained by adjusting the cross-sectional shape and cross-sectional size of the spinning nozzle, the spinning conditions such as the spinning rate and the nozzle draft, and the draw ratio, which will be described later, as appropriate.

An aqueous solution containing a good solvent such as dimethyl sulfoxide at a concentration of 20 wt % or more and 70 wt % or less can be used for the coagulation bath. The temperature of the coagulation bath may be 5° C. or higher and 40° C. or lower. If the concentration of the organic solvent in the coagulation bath is too low, the coagulation is accelerated, and thus it is likely that a coagulation structure will be coarse and voids will be formed inside the fiber.

Next, in the bath drawing process, the acrylic fibers (coagulated filaments) are preferably subjected to bath drawing (also referred to as "primary drawing") in a drawing bath. For the drawing bath, an aqueous solution containing a good solvent such as dimethyl sulfoxide at a concentration lower than that in the coagulation bath can be used. The temperature of the drawing bath is preferably 30° C. or higher, more preferably 40° C. or higher, and even more preferably 50° C. or higher. The draw ratio is not particularly limited, but is preferably, for example, 2 to 8 times from the viewpoint of improving the fiber strength and the productivity. Note that when the primary drawing is performed using a water bath, the bath drawing process may be performed after the water-washing process, which will be described later, or the primary drawing and the water washing may be performed simultaneously.

Next, in the water-washing process, the good solvent such as dimethyl sulfoxide is removed from the acrylic fibers by washing the acrylic fibers with warm water at 30° C. or higher. Alternatively, the primary drawing and the water washing may be performed simultaneously after the coagulated filaments are introduced into warm water at 30° C. or higher. In the water-washing process, using warm water at, for example, 70° C. or higher makes it easy to remove the good solvent such as dimethyl sulfoxide in the acrylic fibers.

In the oil application process, an aqueous solution or aqueous dispersion (also referred to as an "oil solution") of the fiber treatment agent containing a fatty acid ester oil and a polyoxyethylene surfactant can be used. Specifically, it is preferable that the fiber treatment agent at a predetermined concentration is introduced into an oil bath, and the filaments that have been subjected to the water-washing process are immersed in the oil bath so that the fiber treatment agent is applied to the acrylic fibers. The temperature of the oil bath is not particularly limited, but is preferably, for example, 40° C. or higher and may be 40° C. or higher and 80° C. or lower. The immersion time is not particularly limited, but is preferably, for example, 1 second or more and 10 seconds or less and may be 1 second or more and 5 seconds or less.

The oil solution may contain other additives to improve the fiber characteristics if necessary as long as the effects of the present invention are not inhibited. Examples of the additives include fiber sizing agents such as a urethane polymer and a cationic ester polymer.

Next, in the drying process, the acrylic fibers to which the fiber treatment agent has been applied can be dried. The drying temperature is not particularly limited, but is, for example, 110° C. or higher and 190° C. or lower. Then, the dried fibers may be further subjected to drawing (secondary drawing) as necessary. The drawing temperature of the secondary drawing is not particularly limited, but may be, for example, 110° C. or higher and 190° C. or lower. The draw ratio is not particularly limited, but is preferably, for example, 1 to 4 times, more preferably 1 to 3 times, and even more preferably 1 to 2 times. The total draw ratio that includes the bath drawing before the drying process is preferably 2 to 10 times, more preferably 2 to 8 times, even more preferably 2 to 6 times, and particularly preferably 2 to 4 times.

Furthermore, the fibers that have been dried or the fibers that have been dried and then drawn are preferably relaxed in the thermal relaxation process. The relaxation rate is not particularly limited, but is preferably, for example, 5% or more, and more preferably 10% or more and 30% or less. The thermal relaxation treatment can be performed in a dry heat atmosphere or a superheated steam atmosphere at a high temperature such as 140° C. or more and 200° C. or less.

The single fiber fineness of the acrylic fiber for artificial hair is preferably 10 dtex or more and 100 dtex or less, more preferably 20 dtex or more and 95 dtex or less, even more preferably 25 detx or more and 85 dtex or less, even more preferably 30 dtex or more and 75 dtex or less, and particularly preferably 35 dtex or more and 65 dtex or less, from the viewpoint of making the acrylic fibers suitable for artificial hair. Setting the single fiber fineness of the acrylic fiber for artificial hair to 35 dtex or more and 65 dtex or less further improves the curl setting properties, particularly the HWS properties.

All the acrylic fibers for artificial hair do not necessarily have the same fineness, cross-sectional shape, and cross-sectional size, and fibers that are different in fineness, cross-sectional shape, and cross-sectional size may be mixed.

The acrylic fibers for artificial hair alone may be used as artificial hair, or a combination of the acrylic fibers for artificial hair and other fibers for artificial hair may be used as artificial hair. In addition, hair ornament products can be produced using the acrylic fibers for artificial hair. The hair ornament products may include other fibers for artificial hair in addition to the above-mentioned acrylic fibers for artificial hair. The other fibers for artificial hair are not particularly limited, but examples thereof include polyvinyl chloride fibers, nylon fibers, polyester fibers, and regenerated collagen fibers.

Examples of the hair ornament products include a fiber bundle for hair, weaving hair, a wig, a braid, a toupee, a hair extension, and a hair accessory.

EXAMPLES

Hereinafter, one or more embodiments of the present invention will be described by way of examples, but the present invention is not limited to the following examples.

Example 1

An acrylic copolymer containing 49 wt % of acrylonitrile, 50 wt % of vinyl chloride, and 1 wt % of sodium styrenesulfonate was dissolved in acetone to produce an acrylic copolymer solution having an acrylic copolymer concentration of 28.0 wt %. Next, carbon black, a cationic liquid red dye, and a cationic liquid blue dye (the cationic liquid red and blue dyes were manufactured by Hodogaya Chemical Co., Ltd.) were added as coloring agents to the resin solution in an amount of 0.6 parts by weight, 0.25 parts by weight, and 0.4 parts by weight with respect to 100 parts by weight of the acrylic copolymer, respectively. Moreover, polyglycidyl methacrylate (weight average molecular weight: 12,000) was added to this solution in an amount of 1.0 part by weight with respect to 100 parts by weight of the acrylic copolymer to produce a spinning solution. A spinning nozzle having a shape shown in FIG. 7 and a size shown in Table 1 was used to extrude the spinning solution into a coagulation bath containing a 35 wt % aqueous solution of acetone at 25° C. so that wet spinning was performed at a spinning rate of 3 m/min and a nozzle draft of 1.26. Then, the solvent was removed by hot water at 75° C. and the coagulated filaments were drawn to 2.2 times their original length. Next, the water-washed primary drawn yarns were immersed in an oil bath (60° C.) containing a fiber treatment agent (containing a fatty acid ester oil and a polyoxyethylene surfactant with a total concentration of 1.8 wt %) for 3 to 5 seconds. Thus, the drawn yarns were impregnated with the oil. Thereafter, the drawn yarns were dried at 130° C. and further drawn to 1.8 times their original length. The resulting yarns were subjected to a 10% relaxation treatment at 140 to 145° C. Thus, acrylic fibers (the adhesion amount of the fiber treatment agent: 0.3 parts by weight) having a single fiber fineness of about 51 dtex were obtained.

Example 2

Acrylic fibers (the adhesion amount of the fiber treatment agent: 0.3 parts by weight) having a single fiber fineness of about 51 dtex were obtained in the same manner as in Example 1, except that a spinning nozzle having a shape shown in FIG. 7 and a size shown in Table 1 was used.

Example 3

Acrylic fibers (the adhesion amount of the fiber treatment agent: 0.3 parts by weight) having a single fiber fineness of about 51 dtex were obtained in the same manner as in Example 1, except that a spinning nozzle having a shape shown in FIG. 8 and a size shown in Table 1 was used.

Example 4

Acrylic fibers (the adhesion amount of the fiber treatment agent: 0.3 parts by weight) having a single fiber fineness of about 51 dtex were obtained in the same manner as in Example 1, except that the wet spinning was performed at a spinning rate of 10 m/min with the discharge amount (the amount of the spinning solution discharged per unit time) being about 3.3 times larger, and the water-washed primary drawn yarns were immersed in the oil bath containing 2.2 wt % of the fiber treatment agent for 1 to 2 seconds and were thus impregnated with the oil.

Example 5

Acrylic fibers (the adhesion amount of the fiber treatment agent: 0.3 parts by weight) having a single fiber fineness of about 63 dtex were obtained in the same manner as in Example 4, except that a spinning nozzle having a shape shown in FIG. 7 and a size shown in Table 1 was used, and the dried yarns were drawn to 1.5 times their original length.

Example 6

Acrylic fibers (the adhesion amount of the fiber treatment agent: 0.3 parts by weight) having a single fiber fineness of about 51 dtex were obtained in the same manner as in Example 4, except that a spinning nozzle having a shape shown in FIG. 8 and a size shown in Table 1 was used to extrude the spinning solution into the coagulation bath containing a 30 wt % aqueous solution of acetone so that wet spinning was performed at a nozzle draft of 1.3, and then the coagulated filaments were immersed in the oil bath containing 2.2 wt % of the fiber treatment agent for 1 to 2 seconds and were thus impregnated with the oil, were dried, and were drawn to 2.0 times their original length.

Example 7

Acrylic fibers (the adhesion amount of the fiber treatment agent: 0.3 parts by weight) having a single fiber fineness of about 51 dtex were obtained in the same manner as in Example 4, except that a spinning nozzle having a shape shown in FIG. 8 and a size shown in Table 1 was used to perform wet spinning at a nozzle draft of 1.17, and then the coagulated filaments were immersed in the oil bath containing 2.2 wt % of the fiber treatment agent for 1 to 2 seconds and were thus impregnated with the oil, were dried, and were drawn to 2.3 times their original length.

Comparative Example 1

Figure 9:
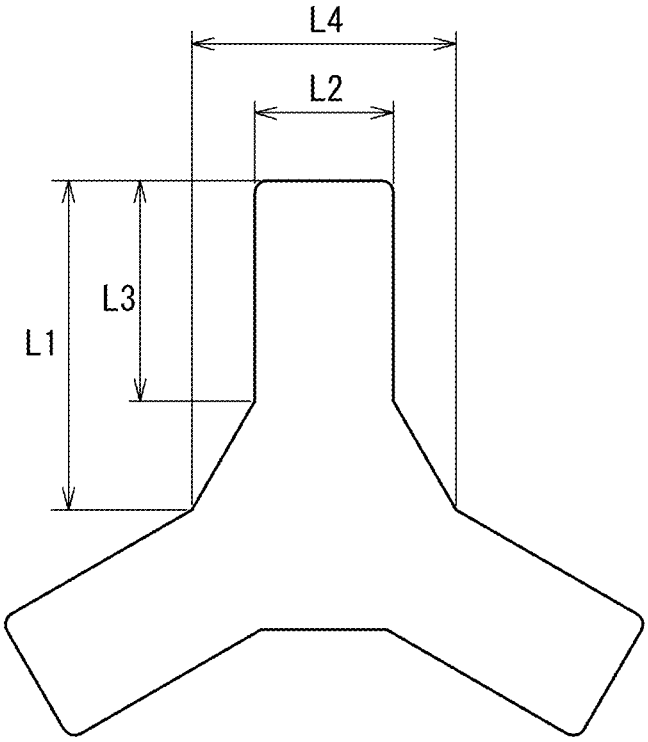
FIG. 9 is a schematic cross-sectional view of a wet-spinning nozzle according to an example.

Acrylic fibers (the adhesion amount of the fiber treatment agent: 0.6 parts by weight) having a single fiber fineness of about 51 dtex were obtained in the same manner as in Example 1, except that a spinning nozzle having a shape shown in FIG. 9 and a size shown in Table 2 was used, the dried yarns were drawn to 2.5 times their original length, and 20% relaxation treatment was performed at 160° C.

Comparative Example 2

Figure 10:
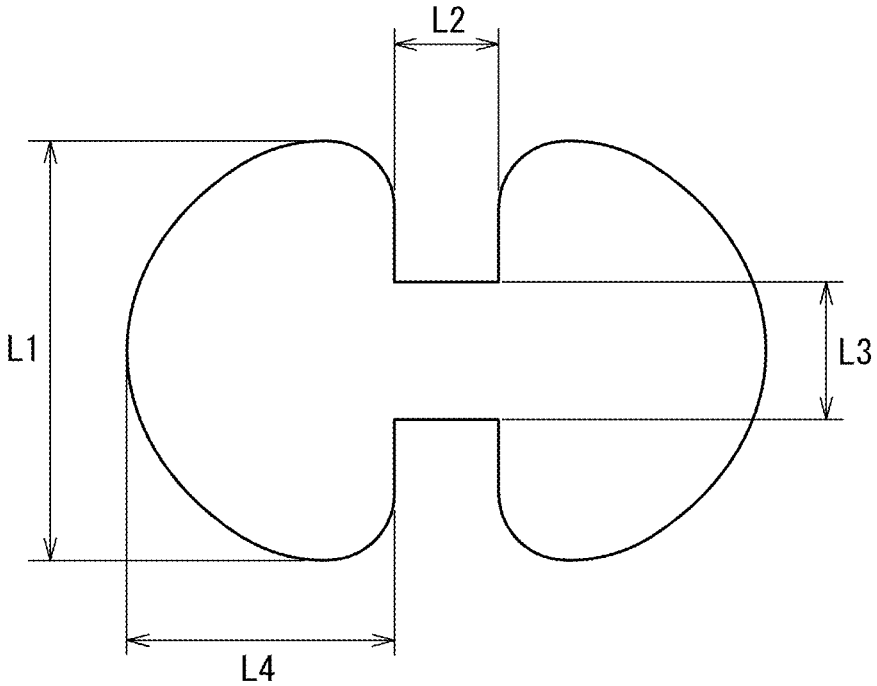
FIG. 10 is a schematic cross-sectional view of a wet-spinning nozzle according to an example.

An acrylic copolymer containing 46 wt % of acrylonitrile, 52 wt % of vinyl chloride, and 2 wt % of sodium styrenesulfonate was dissolved in dimethyl sulfoxide to produce an acrylic copolymer solution having an acrylic copolymer concentration of 28.0 wt % and a water concentration of 3.5 wt %. Next, carbon black, a red dye (C. I. Basic Red 46), and a blue dye (C. I. Basic Blue 41) were added as coloring agents to the resin solution in an amount of 2.1 parts by weight, 0.04 parts by weight, and 0.07 parts by weight with respect to 100 parts by weight of the acrylic copolymer, respectively. Moreover, polyglycidyl methacrylate (weight average molecular weight: 12,000) was added to this solution in an amount of 1.0 part by weight with respect to 100 parts by weight of the acrylic copolymer to produce a spinning solution. A spinning nozzle having a shape shown in FIG. 10 and a size shown in Table 2 was used to extrude the spinning solution into a coagulation bath containing a 52 wt % aqueous solution of DMSO at 20° C. so that wet spinning was performed at a spinning rate of 2 m/min and a nozzle draft of 1.15. Then, the coagulated filaments were drawn to 2.4 times their original length in a drawing bath containing a 30 wt % aqueous solution of DMSO at 90° C. Subsequently, the filaments were washed with warm water at 80° C. Next, the water-washed primary drawn yarns were immersed in an oil bath (60° C.) containing a fiber treatment agent (containing a fatty acid ester oil and a polyoxyethylene surfactant with a total concentration of 6 wt %) for 3 to 5 seconds. Thus, the drawn yarns were impregnated with the oil. Thereafter, the drawn yarns were dried at 140° C. and further drawn to 2 times their original length. The resulting yarns were subjected to a 20% relaxation treatment at 160° C. Thus, acrylic fibers (the adhesion amount of the fiber treatment agent: 0.45 parts by weight) having a single fiber fineness of about 46 dtex were obtained.

Comparative Example 3

Acrylic fibers (the adhesion amount of the fiber treatment agent: 0.3 parts by weight) having a single fiber fineness of about 46 dtex were obtained in the same manner as in Example 1, except that a spinning nozzle having a shape shown in FIG. 8 and a size shown in Table 1 was used, and the dried yarns were drawn to 2.0 times their original length.

Comparative Example 4

Acrylic fibers (the adhesion amount of the fiber treatment agent: 0.3 parts by weight) having a single fiber fineness of about 40 dtex were obtained in the same manner as in Example 4, except that a spinning nozzle having a shape shown in FIG. 7 and a size shown in Table 1 was used, and the dried yarns were drawn to 2.4 times their original length.

In Examples 1 to 7 and Comparative Examples 1 to 4, the adhesion amount of the fiber treatment agent was measured and calculated as follows.

Adhesion Amount of Fiber Treatment Agent A sample (fiber) of about 2 g (sample weight W0) was cut into 12 to 15 cm and packed in a stainless-steel tube (oil extraction tube) having a hole of about 1 mm at the lower end. Next, 35 mL of a mixed solution containing ethanol and cyclohexane at a weight ratio of 1:1 was prepared as an extractant for the fiber treatment agent, and about 20 mL of the extractant was poured into the oil extraction tube. The lid of the oil extraction tube was adjusted so that the drop rate of the extractant was about 1 drop per 1 to 1.5 seconds. Then, the extraction of the fiber treatment agent was started. In this case, a tray (empty tray weight W1) heated to 120° C. by a heater was used as a saucer for liquid drops and placed in such a way that the dropping liquid fell there. When the dropping was finished, the lid was once removed, and the fibers present in the oil extraction tube were pushed with a stainless-steel rod to squeeze the extractant. This operation was repeated by using the remaining extractant (about 15 mL). Upon the completion of the extraction, the tray was placed in an oven at 90° C. and taken out of the oven after 5 minutes. Consequently, the extractant dried out and only the fiber treatment agent remained on the tray. The total weight (W2) of this tray was measured, and the amount of the fiber treatment agent adhered to 100 parts by weight of the fibers was calculated by Formula 1 below.

Oil adhesion amount (parts by weight) = Formula 1

$$(W2 - W1)/(W0 + W1 - W2) \times 100$$

TABLE 1

| | Nozzle cross-sectional shape | Nozzle cross-sectional size Aw* (mm) | Cw* (mm) | Cd* (mm) | Pore area ($mm^2$) |
|---|---|---|---|---|---|
| Ex. 1 | FIG. 7 | 0.11 | 0.060 | 0.46 | 0.096377 |
| Ex. 2 | FIG. 7 | 0.10 | 0.060 | 0.48 | 0.097274 |
| Ex. 3 | FIG. 8 | 0.12 | 0.073 | 0.42 | 0.097800 |
| Ex. 4 | FIG. 7 | 0.11 | 0.060 | 0.46 | 0.096377 |
| Ex. 5 | FIG. 7 | 0.09 | 0.060 | 0.50 | 0.096285 |
| Ex. 6 | FIG. 8 | 0.09 | 0.077 | 0.49 | 0.1023 |
| Ex. 7 | FIG. 8 | 0.09 | 0.077 | 0.49 | 0.1023 |
| Comp. Ex. 3 | FIG. 8 | 0.07 | 0.072 | 0.55 | 0.098000 |
| Comp. Ex. 4 | FIG. 7 | 0.09 | 0.060 | 0.50 | 0.096285 |

Aw*: slit width;
Cw*: canal width;
Cd*: diameter of circumcircle

TABLE 2

| | Nozzle cross-sectional shape | Nozzle cross-sectional size L1 (mm) | L2 (mm) | L3 (mm) | L4 (mm) | Pore area ($mm^2$) |
|---|---|---|---|---|---|---|
| Comp. Ex. 1 | FIG. 9 | 0.312 | 0.121 | 0.207 | 0.242 | 0.11340 |
| Comp. Ex. 2 | FIG. 10 | 0.279 | 0.07 | 0.088 | 0.175 | 0.08538 |

Figure 11:
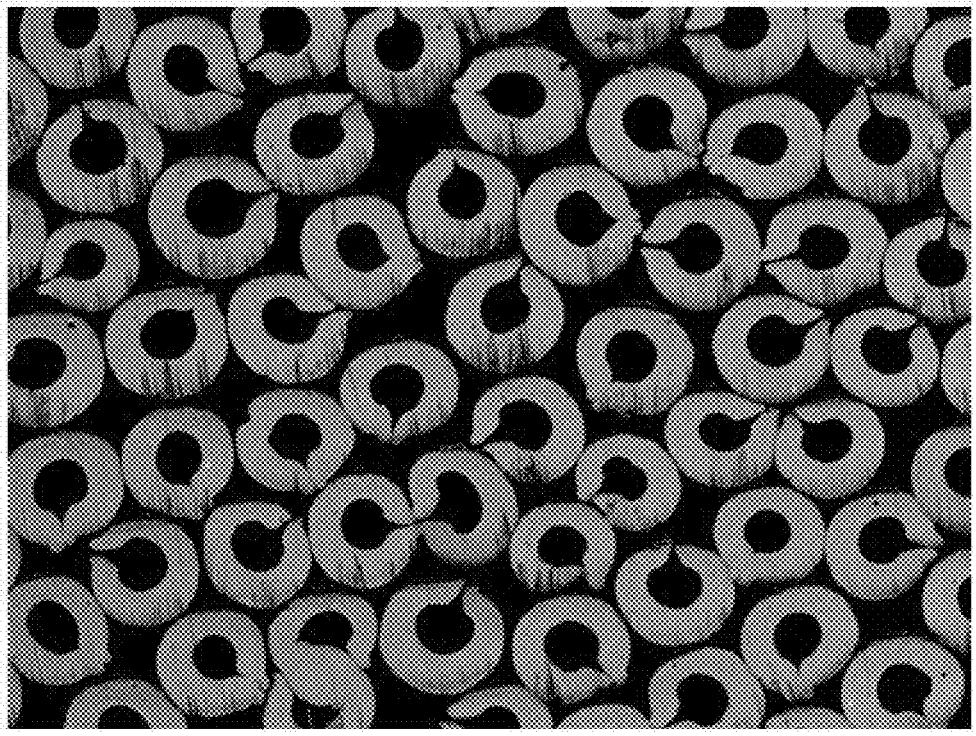
FIG. 11 is a photograph (400-fold magnification) showing the cross-sections of acrylic fibers according to Example 1.
Figure 12:
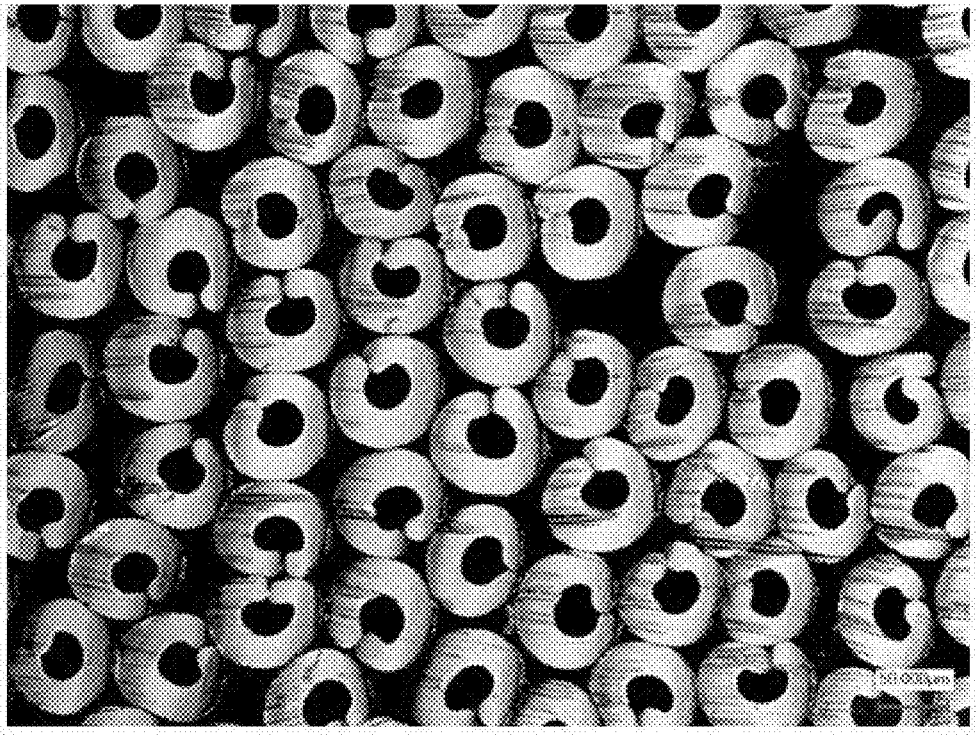
FIG. 12 is a photograph (400-fold magnification) showing the cross-sections of acrylic fibers according to Example 2.
Figure 13:
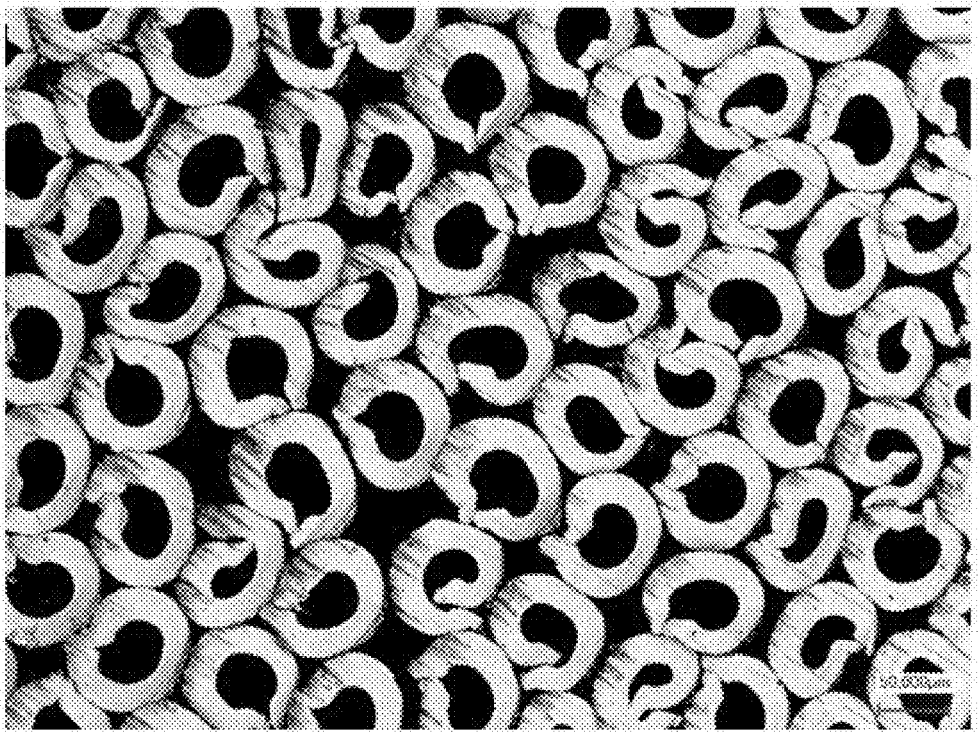
FIG. 13 is a photograph (400-fold magnification) showing the cross-sections of acrylic fibers according to Example 3.
Figure 14:
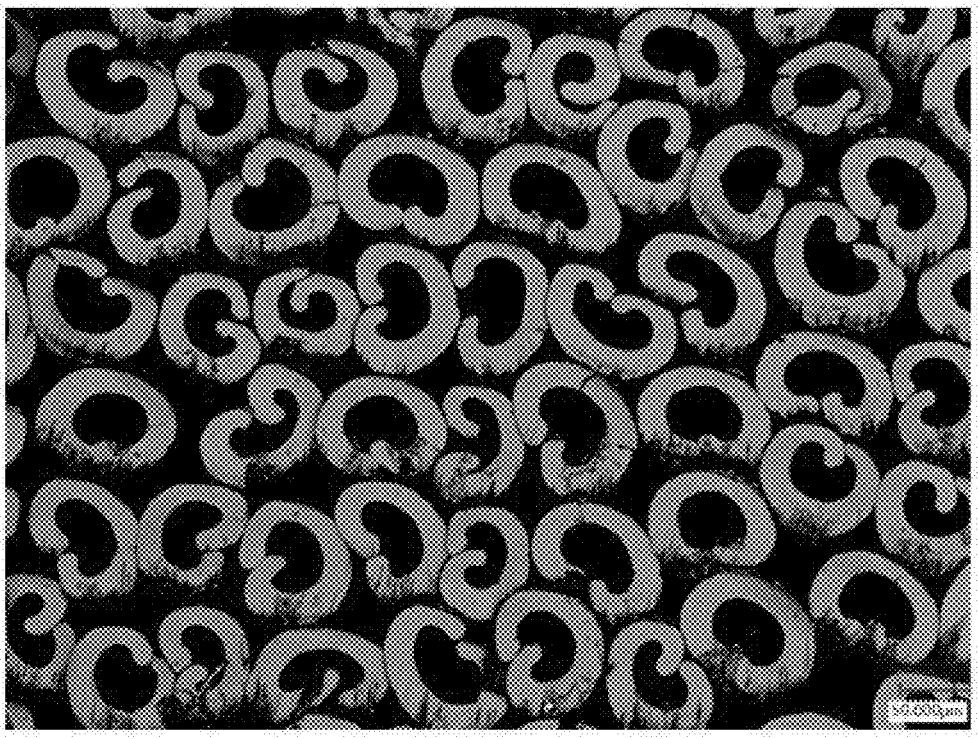
FIG. 14 is a photograph (400-fold magnification) showing the cross-sections of acrylic fibers according to Example 6.
Figure 15:
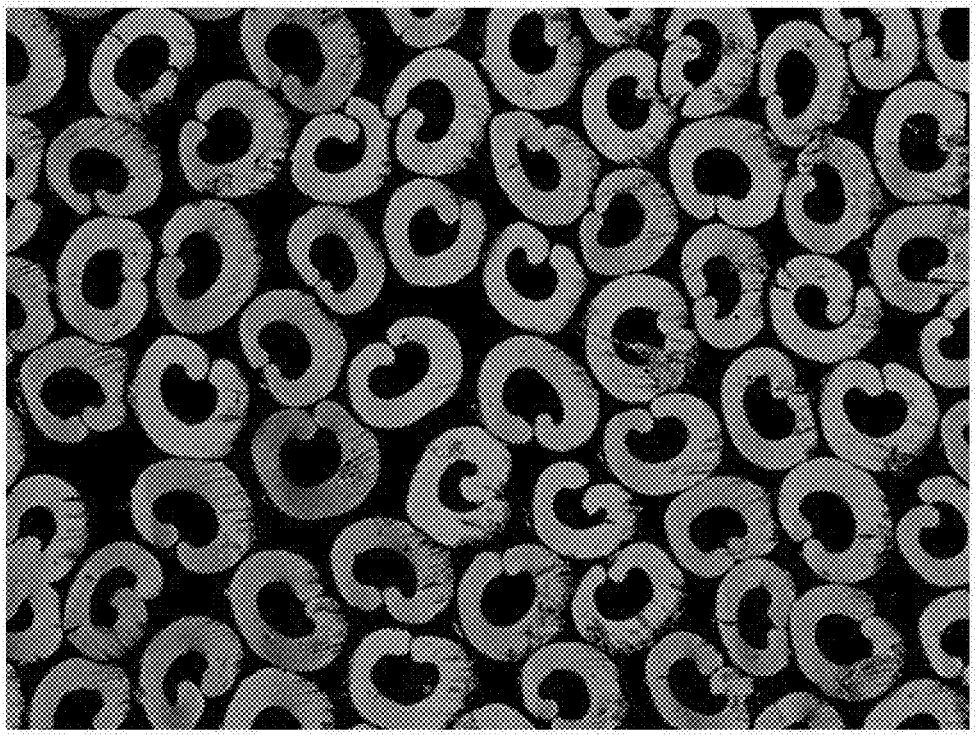
FIG. 15 is a photograph (400-fold magnification) showing the cross-sections of acrylic fibers according to Example 7.
Figure 16:
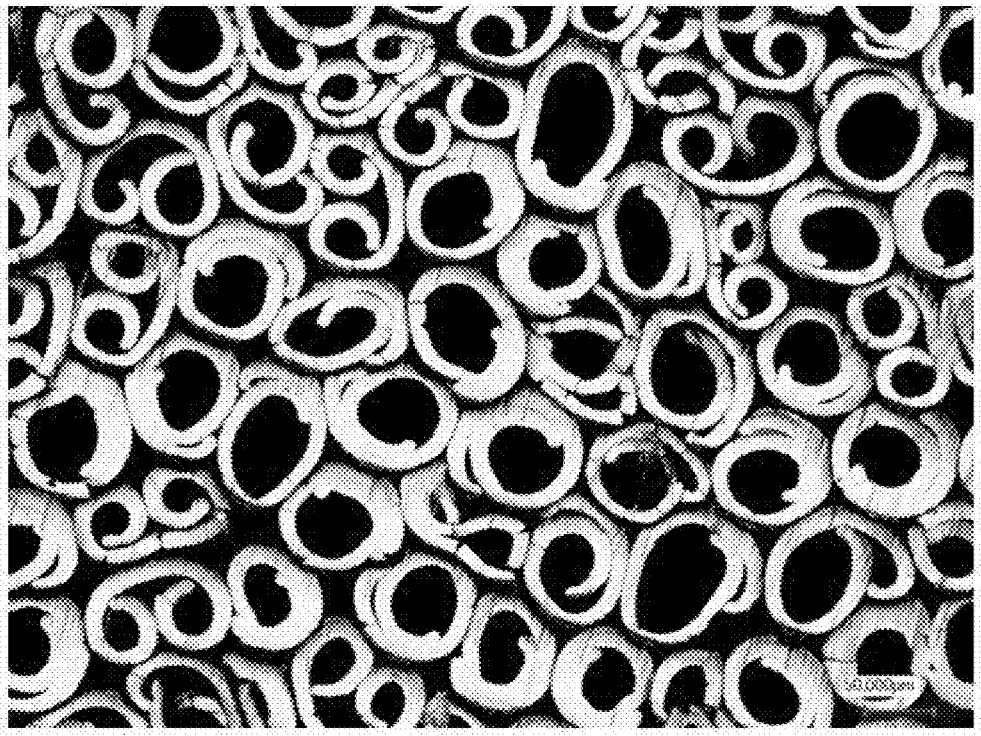
FIG. 16 is a photograph (400-fold magnification) showing the cross-sections of acrylic fibers according to Comparative Example 3.

The cross-sections of the acrylic fibers of Examples 1 to 7 and Comparative Examples 1 to 4 were observed using a microscope as follows. The image analysis was performed as follows using the photographs of the cross-sections to measure the diameter of a circumcircle, the diameter of an inscribed circle, the maximum thickness, the minimum thickness, the canal width, and the angle between the ends. Table 3 below shows the results. Also, the torsional rigidity and flexural rigidity of the acrylic fibers of Examples 1 to 7 and Comparative Examples 1 to 4 were measured and evaluated as follows. Table 4 below shows the results. Also, the bulkiness, touch, and HWS properties of the acrylic fibers of Examples 1 to 7 and Comparative Examples 1 to 4 were measured and evaluated as follows. Table 4 below shows the results. FIGS. 11 to 16 show photographs of the cross-sections of the fibers of Examples 1 to 3, 6, and 7 and Comparative Example 3, respectively. In Example 1, as shown in FIG. 11, all the fibers in the observation view had a C-shaped cross-section. In Examples 2 and 3, as shown in FIGS. 12 and 13, most of the fibers in the observation view had a C-shaped cross-section, but some fibers had a figure-6-shaped cross-section. In Example 6, as shown in FIG. 14, the C-shaped cross-sections, the figure-6-shaped cross-sections, and the hollow broad bean-shaped cross-sections were mixed. In Example 7, as shown in FIG. 15, the C-shaped cross-sections and the figure-6-shaped cross-sections were mixed.

Method for Observing Fiber Cross-Section

Preparation of Sample

The acrylic fibers were cut into 15 cm long, and an appropriate amount of the acrylic fibers were packed in a heat-shrinkable tube (manufactured by Junkosha Inc., model number "FEP-040," inner diameter before shrinkage: φ4.5 mm, inner diameter after shrinkage: φ3.3 mm, length: 1 μm). Then, the tube was allowed to stand in an oven at 105° C. for 5 minutes. Then, the tube was taken out of the oven and left to cool. After the heat-shrinkable tube was cooled, the tube that had shrunk and been filled with the acrylic fibers was cut to a length of about 3 mm with a razor blade. Thus, samples for observation of the fiber cross-section were prepared.

Observation and Photography

The samples for observation of the fiber cross-section were observed and photographed using a laser microscope (VK-X260, manufactured by KEYENCE CORPORATION) in a range of observation and measurement of 675 μm in width×506 μm in length. The observation and photography were performed at a total of 5 points for each of the samples.

Method for Analyzing Photograph of Cross-Section

Image analysis software (WinROOF, Mitsubishi Shosha Co., Ltd.) was used to import the photographs of the cross-sections, and the following parameters were defined and measured.

Diameter of Circumcircle

The diameters of circumcircles of three cross-sections in total were measured, and the average value thereof was taken as the diameter of a circumcircle. For example, in FIGS. 1 to 6, the diameter of the circumcircle is indicated as R1.

Diameter of Inscribed Circle

The diameters of inscribed circles of three cross-sections in total were measured, and the average value thereof was taken as the diameter of an inscribed circle. For example, in FIGS. 1 to 6, the diameter of the inscribed circle is indicated as R2.

Thickness

The maximum thickness (maximum wall thickness) of one cross section was measured, and the average value of those from three cross-sections in total was taken as the maximum thickness t1.

The minimum thickness (minimum wall thickness) of one cross section was measured, and the average value of those from three cross-sections in total was taken as the minimum thickness t2.

For example, in FIGS. 1 to 6, the thickness is indicated as t.

Canal Width

In the C-shaped fiber cross-section, the width between the two ends of the C-shape (the distance between the two points) was measured, and the average value of those from three cross-sections in total was taken as the canal width. For example, in FIG. 1, the canal width is indicated as W. When the fiber cross-section had a figure-6-shape or a hollow broad bean-shape, the canal width was 0 μm.

Angle Between Ends

In the C-shaped fiber cross-section, an angle between line segments that connect the center of an inscribed circle and the two ends of the C-shape was measured, and the average value of those from three cross-sections in total was taken as the angle between the ends. For example, in FIG. 1, the angle between the ends is indicated as θ. When the fiber cross-section had a figure-6-shape or a hollow broad bean-shape, the angle between the ends was 0°.

Content of C-shaped Fiber Cross-Section

In five photographs of the cross-sections, the number of the C-shaped cross-sections and the number of all the cross-sections were measured, and the content (%) of the C-shaped fiber cross-sections was calculated using "number of C-shaped cross-sections/number of all cross-sections×100."

Content of Figure-6-Shaped Fiber Cross-Section

In five photographs of the cross-sections, the number of the figure-6-shaped cross-sections and the number of all the cross-sections were measured, and the content (%) of the figure-6-shaped fiber cross-sections was calculated using "number of figure-6-shaped cross-sections/number of all cross-sections×100." Content of Hollow Broad Bean-Shaped Fiber Cross-Section In five photographs of the cross-sections, the number of the hollow broad bean-shaped cross-sections and the number of all the cross-sections were measured, and the content (%) of the hollow broad bean-shaped fiber cross-sections was calculated using "number of hollow broad bean-shaped cross-sections/number of all cross-sections×100."

Method for Measuring Torsional Rigidity

A torsion tester (KES-YN1, manufactured by KATO TECH CO., LTD.) was used to measure the torsional rigidity of a sample (single yarn) with a length of 3 cm under the conditions that the number of twists was ±3 twists and the torsion speed was 12°/sec. The average value of 5 measurements was calculated as the value of the torsional rigidity (unit: mg-cm$^2$).

Method for Measuring Flexural Rigidity

A pure bending tester (KES-FB2, manufactured by KATO TECH CO., LTD.) was used to measure the flexural rigidity as follows.

Forty-nine fibers (single yarns) were attached to a mount at intervals of 1 mm, and the fibers were fixed on the top and the bottom with a cellophane tape so as not to come loose. The obtained sample was fixed to a jig of the apparatus and measured at a deformation rate of 0.5 cm/sec with a curvature of −2.5 to +2.5 (cm$^{-1}$). The average value of repulsion was measured when the curvature was in the range of 0.5 to 1.5 (cm$^{-1}$). Then, the value per fiber was calculated and taken as the flexural rigidity.

Method for Evaluating Bulkiness

Sample Preparation Method

About 270 g of the acrylic fibers were processed at a take-up speed of 1.5 to 2 m/min, a gear temperature of 90 to 100° C., and a gear pitch of 2.5 mm to have a crimp angle of 141°±3° (the average of 5 fibers, each of which had been measured at one point). Thus, a crimped tow was obtained.

Volume Evaluation Method

A professional beauty evaluator made two BRDs (braids) using the crimped tow of 45.7 cm×4 g (length×weight) for each braid. The width and thickness of one BRD were measured at 10 points each by a vernier caliper. Based on the average value of the widths and the average value of the thicknesses of the two BRDs, the width and the thickness were calculated. Next, the product of the width and the thickness (width×thickness) was calculated as a volume evaluation value. The ratio of the volume evaluation value to a volume evaluation value at a comparative level (Comparative Example 2) was calculated and taken as a volume increase rate. If the volume increase rate was 10% or more, the sample was acceptable (favorable). If the volume increase rate was less than 10%, the sample was unacceptable.

Method for Evaluating Touch

Three professional beauty evaluators conducted a sensory evaluation using a fiber bundle of 30 cm×30 g (length×weight). In this case, the professional beauty evaluators graded each fiber bundle according to the degree of touch on a scale of 1 to 5, where 5 was a comparative level (Comparative Example 2, in which the touch of the fibers was very similar to that of human hair). Then, the average value was calculated. Based on the average value, the touch was evaluated according to the following three levels.

A: more than 4.0 and 5.0 or less

B: more than 2.0 and 4.0 or less

C: 2.0 or less

Method for Evaluating HWS Properties

A fiber bundle with a length of 20 inches (50.8 cm) and a weight of 2 g was used. The fiber bundle was wrapped around a pipe (metal cylinder) with a diameter of 7 mm and fixed, and immersed in hot water at 90° C. for 15 seconds. Subsequently, the fiber bundle was left drying in a dryer (40° C.) for 2 hours. The dried fiber bundle was removed from the pipe and immediately loosened by pinching the fibers, so that the fiber bundle was undone. Then, the fiber bundle was hung, and the length of the fiber bundle immediately after hanging was measured. Using the length of a fiber bundle immediately after hanging in Comparative Example 2 as a control level, the measured length of the fiber bundle immediately after hanging was evaluated according to the following three levels.

A: The length immediately after hanging was +1 cm or less longer than the control level.

B: The length immediately after hanging was more than +1.1 cm and 2.0 cm or less longer than the control level.

C: The length immediately after hanging was more than +2.0 cm longer than the control level.

TABLE 3

| | Single fiber fineness (dtex) | Cross-section | | | | | | | |
|---|---|---|---|---|---|---|---|---|---|
| | | Shape | C-shaped cross-section content (%) | R1 (μm) | R2 (μm) | t1 (μm) | t2 (μm) | Angle between ends θ (°) | Canal width (μm) |
| Ex. 1 | 51 | Mainly C-shape, with FIG.-6-shape mixed | 95 | 85 | 40 | 27 | 18 | 2 | 2 |
| Ex. 2 | 51 | Mainly C-shape, with FIG.-6-shape mixed | 81 | 95 | 45 | 25 | 16 | 5 | 2 |
| Ex. 3 | 51 | Mainly C-shape, with FIG.-6-shape mixed | 96 | 86 | 28 | 26 | 20 | 3 | 2 |
| Ex. 4 | 51 | Mainly C-shape, with FIG.-6-shape mixed | 98 | 82 | 26 | 31 | 18 | 0 | 0 |
| Ex. 5 | 63 | Mainly C-shape, with FIG.-6-shape mixed | 99 | 100 | 45 | 28 | 17 | 0.3 | 1 |
| Ex. 6 | 51 | C-shape, FIG.-6-shape, and hollow broad bean-shape mixed | C-shape: 8% FIG.-6-shape: 55% Hollow broad bean-shape: 37% | 98 | 27 | 24 | 14 | 0 | 0 |
| Ex. 7 | 51 | C-shape and FIG.-6-shape mixed | 65 | 91 | 27 | 26 | 14 | 0 | 0 |
| Comp. Ex. 1 | 51 | Y-shape | none | 120 | — | 40 | 26 | — | 74 |
| Comp. Ex. 2 | 46 | H-shape | none | 76 | — | 75 | 28 | — | 16 |
| Comp. Ex. 3 | 46 | FIG.-6-shape | 0 | 88 | 48 | 14 | 11 | 0 | 0 |
| Comp. Ex. 4 | 40 | C-shape | 97 | 78 | 32 | 22 | 11 | 0 | 0 |

TABLE 4

| | Torsional rigidity (mg · cm$^2$) | Flexural rigidity (×10$^{-3}$ gf · cm$^2$/yarn) | Volume increase rate (bulkiness) | Touch | HWS properties |
|---|---|---|---|---|---|
| Ex. 1 | 2.10 | 7.40 | 35% | A | A |
| Ex. 2 | 1.80 | 8.10 | 41% | A | A |
| Ex. 3 | 3.38 | 7.30 | 34% | A | A |
| Ex. 4 | 4.80 | 6.20 | 25% | A | A |
| Ex. 5 | 2.61 | 12.80 | 56% | A | A |
| Ex. 6 | 1.60 | 7.70 | 37% | A | A |
| Ex. 7 | 1.82 | 8.20 | 31% | A | A |
| Comp. Ex. 1 | 2.67 | 9.70 | 49% | C | B |
| Comp. Ex. 2 | 3.85 | 3.85 | 0% | A | A |
| Comp. Ex. 3 | 0.56 | 9.00 | 56% | A | C |
| Comp. Ex. 4 | 0.97 | 5.80 | 33% | A | C |

As is clear from Tables 3 and 4, the acrylic fibers of the examples had favorable bulkiness, touch, and HWS properties.

On the other hand, the acrylic fibers of Comparative Example 1 with a Y-shaped cross-section had poor touch. The acrylic fibers of Comparative Example 2 with an H-shaped cross-section had poor bulkiness. The acrylic fibers of Comparative Example 3 whose fiber cross-section had a figure-6-shaped cross-section but had a small thickness had poor HWS properties. The acrylic fibers of Comparative Example 4 whose fiber cross-section had a C-shaped cross-section but had a small thickness had poor HWS properties.

DESCRIPTION OF REFERENCE CHARACTERS

1*a*, 1*b* Linear portion at end of spinning nozzle
2*a*, 2*b* Protrusion at end of spinning nozzle
3*a*, 3*b* End of spinning nozzle

The invention claimed is:

1. An acrylic fiber for artificial hair comprising an acrylic copolymer, wherein a fiber cross-section of the acrylic fiber for artificial hair has one or more shapes selected from the group consisting of a C-shape, a figure-6-shape, and a broad bean-shape with a hollow portion, two ends of the C-shape, the figure-6-shape, or the broad bean-shape with the hollow portion are apart from each other or are in contact with each other, a circumcircle of the fiber cross section has a diameter of 70 μm or more and 100 μm or less, an inscribed circle of the fiber cross section has a diameter of 15 μm or more and 50 μm or less, a thickness of the fiber cross section is 13 μm or more and 40 μm or less, and a canal width between the ends of the fiber cross section is 0 μm or more and 15 μm or less, an angle between the ends in the fiber cross-section is 0° or more and 0.3° or less, and the acrylic fiber for artificial hair has a torsional rigidity of 1.3 $mg \cdot cm^2$ or more and 6.0 $mg \cdot cm^2$ or less.

2. The acrylic fiber for artificial hair according to claim 1, wherein the acrylic fiber for artificial hair has a single fiber fineness of 35 dtex or more and 65 dtex or less.

3. The acrylic fiber for artificial hair according to claim 1, comprising the fiber with the C-shaped cross-section.

4. The acrylic fiber for artificial hair according to claim 1, wherein a fiber treatment agent is adhered to the acrylic fiber for artificial hair, and the fiber treatment agent contains a fatty acid ester oil and polyoxyethylene surfactant.

5. The acrylic fiber for artificial hair according to claim 1, wherein the acrylic copolymer comprises acrylonitrile in an amount of 29.5 wt % or more and 79.5 wt % or less, one or more monomer selected from the group consisting of vinyl chloride and vinylidene chloride in an amount of 20 wt % or more and 70 wt % or less, and a sulfonic acid group-containing vinyl monomer in an amount of 0.5 wt % or more and 5 wt % or less.

6. A hair ornament product comprising the acrylic fiber for artificial hair according to claim 1.

7. The hair ornament product according to claim 6, which is at least one selected from the group consisting of a fiber bundle for hair, weaving hair, a wig, a braid, a toupee, a hair extension, and a hair accessory.

8. A method for producing the acrylic fiber for artificial hair according to claim 1, comprising:

performing wet spinning using a spinning solution containing an acrylic copolymer, wherein a nozzle used for the wet spinning has a C-shaped cross-section with two ends being apart from each other, and each of the two ends of the C-shape has a linear portion and a protrusion bulging outward, the linear portions of the two ends being parallel to each other, or one end of the C-shape is located on a side close to a hollow portion with respect to the other end.

9. The hair ornament product according to claim 6, wherein the acrylic fiber for artificial hair has a single fiber fineness of 35 dtex or more and 65 dtex or less.

10. The hair ornament product according to claim 6, wherein the acrylic fiber for artificial hair comprises the fiber with the C-shaped cross-section.

11. The hair ornament product according to claim 6, wherein a fiber treatment agent is adhered to the acrylic fiber for artificial hair, and the fiber treatment agent contains a fatty acid ester oil and polyoxyethylene surfactant.

12. The hair ornament product according to claim 6, wherein the acrylic copolymer comprises acrylonitrile in an amount of 29.5 wt % or more and 79.5 wt % or less, one or more monomer selected from the group consisting of vinyl chloride and vinylidene chloride in an amount of 20 wt % or more and 70 wt % or less, and a sulfonic acid group-containing vinyl monomer in an amount of 0.5 wt % or more and 5 wt % or less.

13. The method for producing the acrylic fiber for artificial hair according to claim 8, wherein the acrylic fiber for artificial hair has a single fiber fineness of 35 dtex or more and 65 dtex or less.

14. The method for producing the acrylic fiber for artificial hair according to claim 8, wherein the acrylic fiber for artificial hair comprises the fiber with the C-shaped cross-section.

15. The method for producing the acrylic fiber for artificial hair according to claim 8, wherein a fiber treatment agent is adhered to the acrylic fiber for artificial hair, and the fiber treatment agent contains a fatty acid ester oil and polyoxyethylene surfactant.

16. The method for producing the acrylic fiber for artificial hair according to claim 8, wherein the acrylic copolymer comprises acrylonitrile in an amount of 29.5 wt % or more and 79.5 wt % or less, one or more monomer selected from the group consisting of vinyl chloride and vinylidene chloride in an amount of 20 wt % or more and 70 wt % or less, and a sulfonic acid group-containing vinyl monomer in an amount of 0.5 wt % or more and 5 wt % or less.

* * * * *